United States Patent [19]

Ramseyer et al.

[11] 4,009,638

[45] Mar. 1, 1977

[54] AMMUNITION CONTAINER

[75] Inventors: Robert Ramseyer, Versoix; Hanspeter Novet, Hegnau, both of Switzerland

[73] Assignee: Werkzeugmaschinenfabrik Oerlikon-Buhrle AG, Zurich, Switzerland

[22] Filed: Apr. 4, 1975

[21] Appl. No.: 565,010

[30] Foreign Application Priority Data

Apr. 10, 1974 Switzerland ..... 5045/74

[52] U.S. Cl. ..... 89/34

[51] Int. Cl.[2] ..... F41C 25/00

[58] Field of Search ..... 89/34, 33 BB, 33 BC; 206/3

[56] References Cited

UNITED STATES PATENTS

| | | | |
|---|---|---|---|
| 2,452,545 | 11/1948 | Broga | 89/34 |
| 2,470,475 | 5/1949 | Diaper | 89/34 |
| 2,569,798 | 10/1951 | Carroll | 89/34 X |
| 2,710,561 | 6/1955 | Dowd | 89/34 |
| 2,811,084 | 10/1957 | Cook et al. | 89/34 |
| 2,874,615 | 2/1959 | Kravik | 89/34 |
| 3,461,774 | 8/1969 | Maurer et al. | 89/34 |

*Primary Examiner*—David H. Brown
*Attorney, Agent, or Firm*—Werner W. Kleeman

[57] ABSTRACT

An ammunition container having at least one compartment in which there is located a loop of a cartridge belt consisting of two adjacently arranged loop portions. The compartment having a rack-like support and recesses or gaps of such support serving for the reception of a respective cartridge of one loop portion of the cartridge belt.

5 Claims, 4 Drawing Figures

AMMUNITION CONTAINER

BACKGROUND OF THE INVENTION

The present invention relates to a new and improved construction of ammunition container having a compartment in which there is located a loop of a cartridge belt consisting of two adjacently arranged loop portions.

According to a state-of-the-art container of this type the compartments are formed by flat partition walls. If one such compartment is so intensively filled that the loop bears against the floor of the compartment and both of the loop portions contact one another in a zig-zag formation in the compartment, then there exists the danger that during the removal of the cartridge belt both loop portions will hook into one another, so that during the withdrawal of the cartridge belt out of the compartment during firing considerable forces are required which could lead to disturbances upon transport of the belt to the weapon.

SUMMARY OF THE INVENTION

It is a primary object of the present invention to provide an improved construction of ammunition container which is not associated with the aforementioned drawbacks and limitations of the prior art.

Another object aims at a new and improved construction of ammunition container wherein the cartridge belt can be easily and positively removed from the container without any danger of tangling or fouling and without the need for exerting any excessive force.

Still another and more specific object of the invention resides in the provision of an ammunition container wherein the one loop portion cannot be located in a zig-zag formation in the compartment and both loop portions during removal cannot hook into one another, so that such removal is insured for in a positive manner without the need to exert large forces and without particular care having to be exercised during filling of the ammunition container to make sure that not too many cartridges are located in a compartment.

Now in order to implement these and still further objects of the invention, which will become more readily apparent as the description proceeds, the inventive ammunition container of this development is manifested by the features that the compartment possesses a rack-like support and there are provided recesses or gaps at the support for taking-up or supporting a respective cartridge of one loop portion.

BRIEF DESCRIPTION OF THE DRAWINGS

The invention will be better understood and the objects other than those set forth above, will become apparent when consideration is given to the following detailed description thereof. Such description makes reference to the annexed drawings wherein there are shown two exemplary embodiments of ammunition container and specifically.

DETAILED DESCRIPTION OF THE INVENTION

Figure 1:
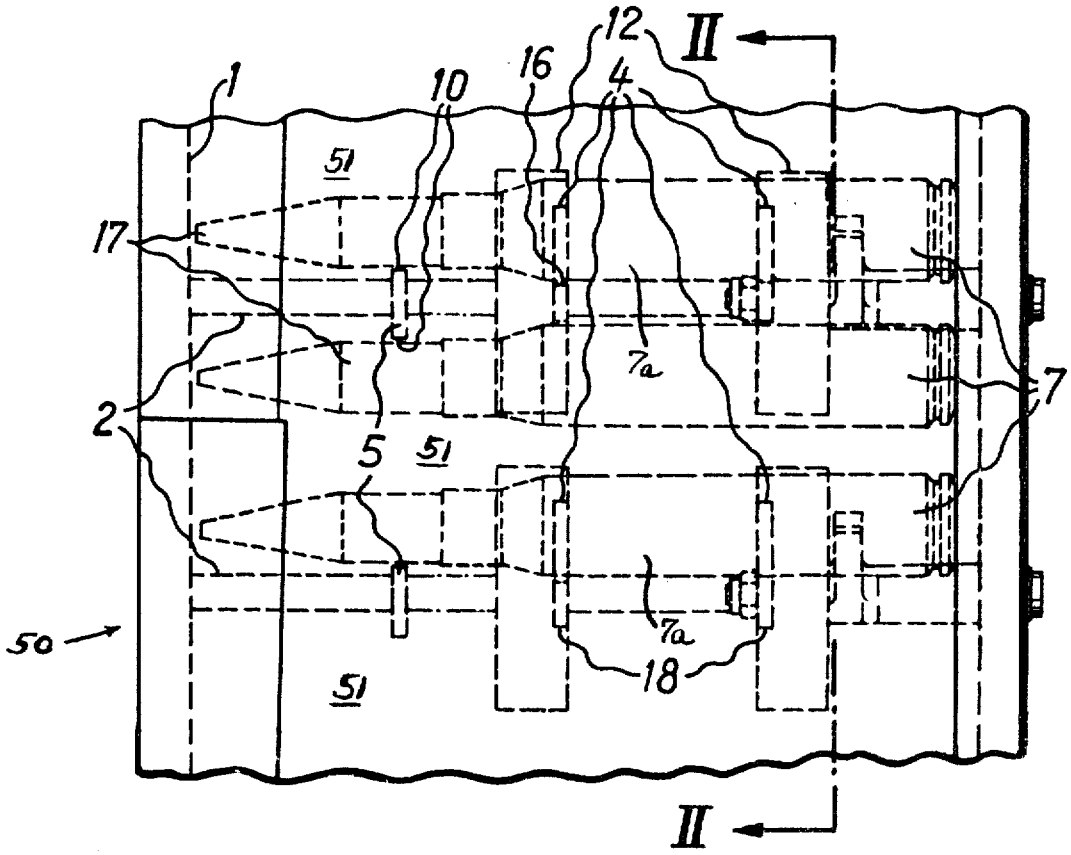
FIG. 1 is a cross-sectional view through a portion of an ammunition container designed according to a first exemplary embodiment of the invention.
Figure 2:
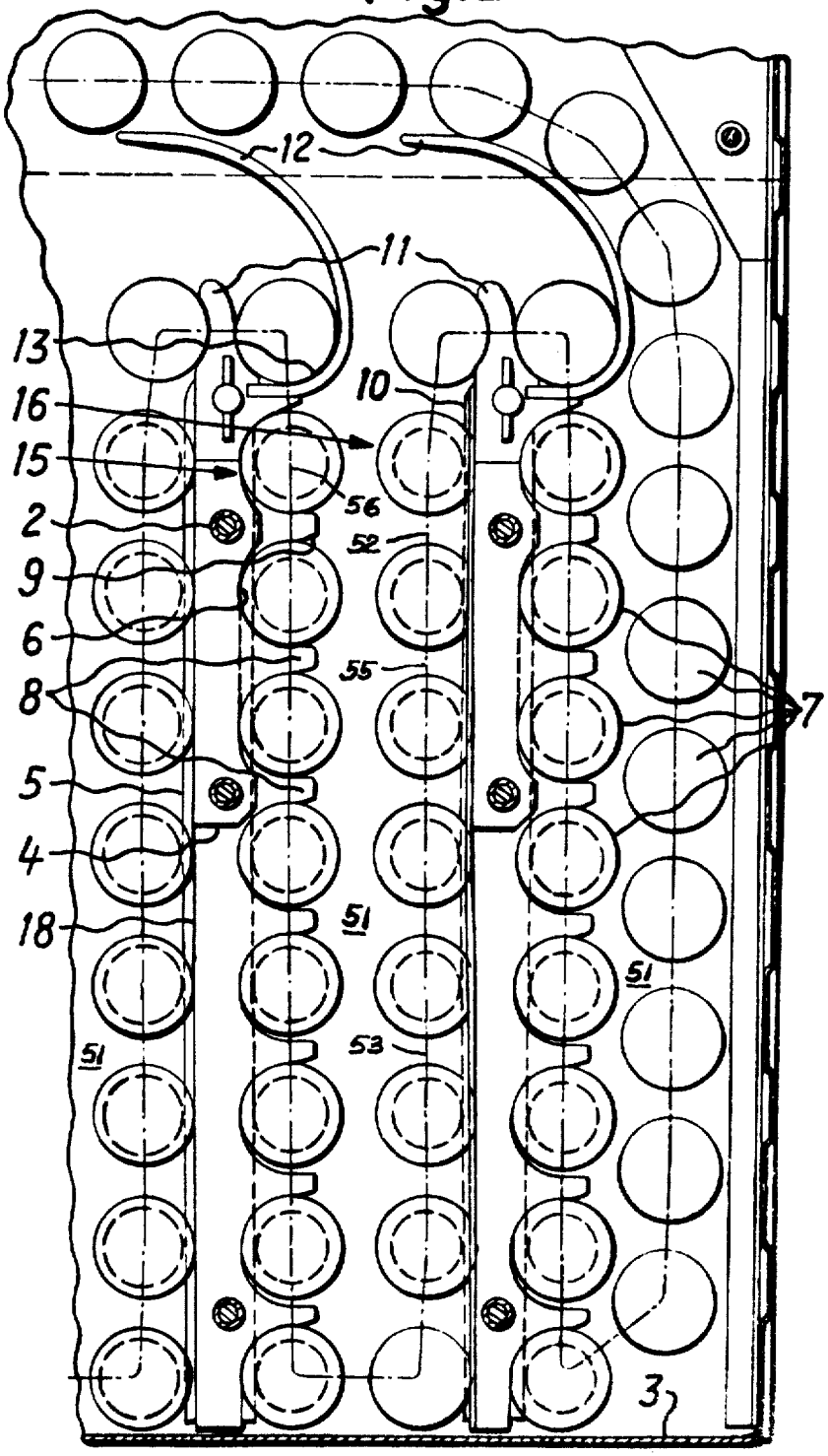
FIG. 2 is a cross-sectional view taken along the line II—II of FIG. 1.

Describing now the drawings, the exemplary embodiment of ammunition container 50 depicted in FIGS. 1 and 2 shows rods 2 secured at two side walls 1 of the ammunition container. These rods 2 are arranged essentially in parallelism with respect to one another and perpendicular to the side walls 1. The axes of each three respective rods 2 arranged in superimposed spaced relationship are located in a respective plane which is disposed perpendicular to the container floor 3. These planes possess the same spacing from one another. At three rods 2 located in one plane there are secured two carriers or supports 4 extending essentially parallel to the side walls 1 and a carrier or support 5.

Both of the rack-shaped supports 4 possess gaps or recesses 6. The spacing of the gaps correspond to the spacing of the cartridges 7 in the belt schematically indicated by reference character 52. The gaps 6 are essentially of semi-circular configuration and separated from one another by teeth 8. These teeth 8 are bounded towards the bottom by a circular-shaped rounded surface 9 which tangentially merges with the semi-circular shaped arcs of the gaps 6. The radii of the gaps or recesses 6 are of the same magnitude at both supports 4. The centers of all gaps or recesses 6 of each two respective associated supports 4 are located in a plane directed perpendicular to the container floor 3 and to the side walls 1 of the container 50. The centers of two respective gaps 6 arranged at both supports 4 are located along a straight line parallel to the container floor 3. The support 5 has an end surface 10, the spacing of which from the axes of the rods 2 is greater than the spacing of the arcs of the gaps 6 from such axes. Each support 4 possesses an upwardly directed tooth 11 at which there is secured a sickle-shaped or curved guide arm 12 for the belt. The teeth 11 together with the arm 12 form a semi-circular-shaped trough or channel 13. Each two neighboring sets of three supports 4, 5 delimit a compartment 51 in which there is housed a loop, such as loop 53, of the cartridge belt 52. At least two of the supports, such as the supports 4 collectively form a partition wall or partition arrangement between two neighboring compartments 51, as best seen by referring to FIG. 1. The cartridges 7 of the belt 52 are hingedly connected with one another in conventional manner by belt elements of standard construction and which therefore have been conveniently omitted from the drawing to preserve clarity in illustration. The troughs or channels 13 form the support points for two cartridges 15, 16 which are arranged in two adjacently disposed compartments 51 of the container. The sleeves **7*a* of the cartridges 7 are located in the gaps or recesses 6 of the supports 4 and the projectiles 17 of the cartridges 7 bear against both end surfaces 10 of support 5. The cartridges 7 furthermore bear against the surfaces 18 of the supports 4. In the showing of FIG. 2 there are visible 2½ compartments 51 and it will be recognized that, for instance, in the intermediate compartment the belt loop 53 comprises two adjacent loop portions 55 and 56, and the recesses or gaps 6 in the showing serve to take-up or support the cartridges 7 of the one belt loop portion 56**.

Upon filling of the belt 52 into the container 50 the length of the loop 53 of such belt 52 which is to be filled into each of the compartments, is determined by the number of gaps or recesses 6 in the supports 4, so that the compartments cannot be over-filled and therefore can be emptied free of any disturbance.

Figure 3:
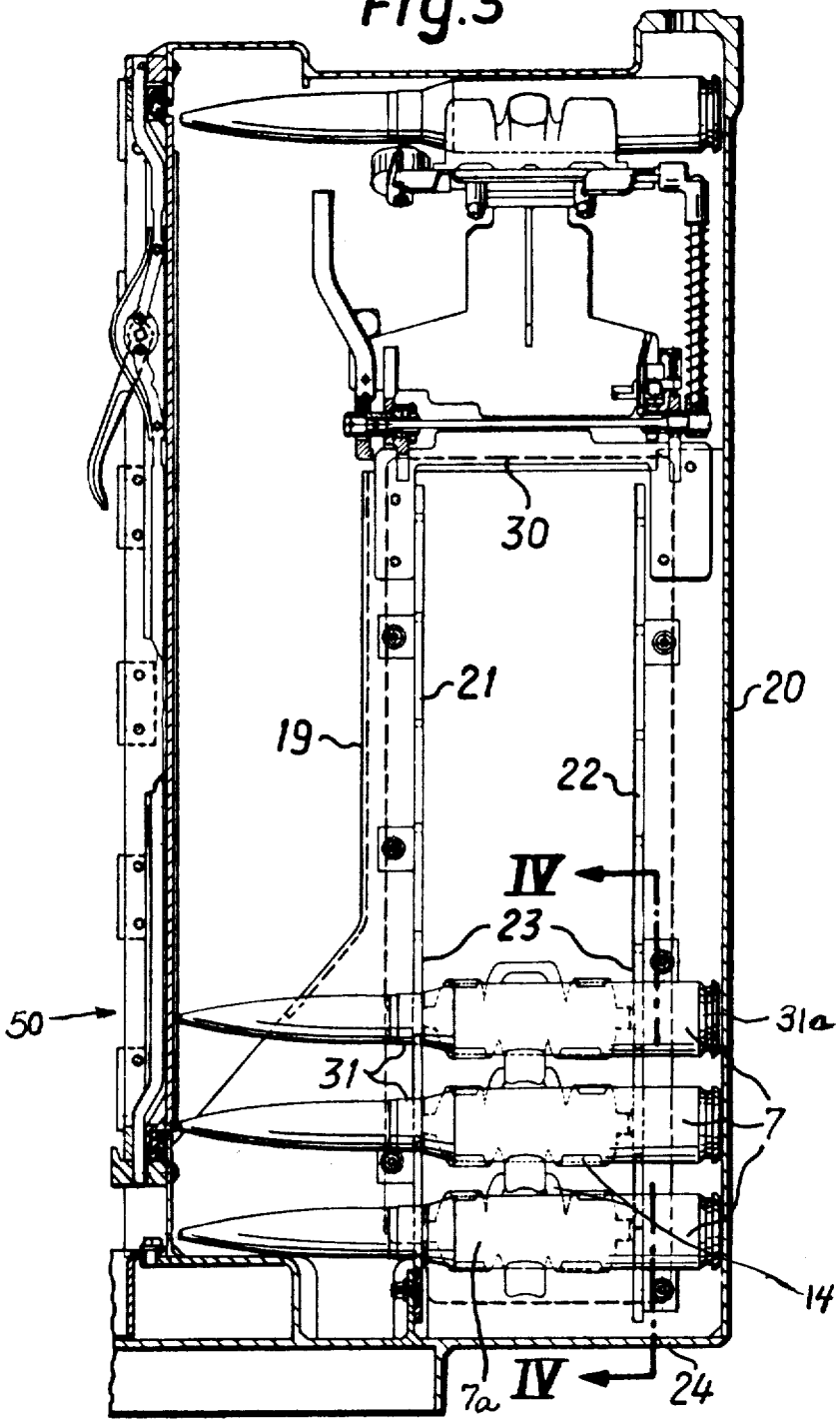
FIG. 3 is a cross-sectional view through an ammunition container designed according to a second embodiment of the invention.
Figure 4:
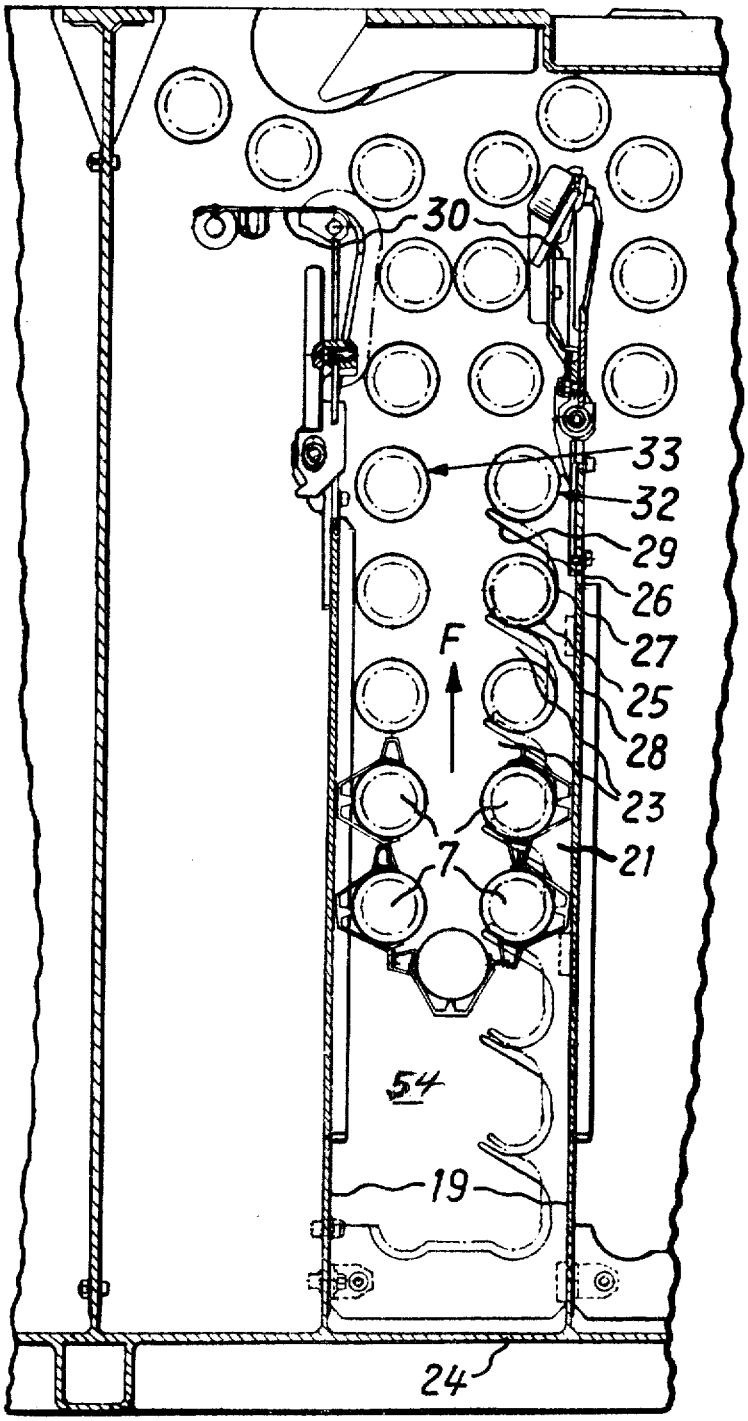
FIG. 4 is a cross-sectional view taken along the line IV—IV of FIG. 3.

With the embodiment shown by way of example in FIGS. 3 and 4 the compartments 54 are delimited by two respective intermediate walls or partitions 19 directed perpendicular to the container wall 20. A pair of carriers or supports 21, 22 is secured at one of the walls 19.

The supports 21, 22 possess gaps or recesses 23 which are arranged at a uniform spacing from one another. The central axes of the gaps 23 together with the container floor 24 enclose acute angles. The base of a gap or recess 23 possesses two substantially circular-shaped rounded portions 25, 26 which tangentially merge at a surface 27 directed perpendicular to the container floor 24. Furthermore, both of the rounded portions 25, 26 tangentially merge with the straight boundary surfaces 28, 29 which are parallel to one another. The rounded portions 25, 26 of the gaps 23 of support 21 possess a smaller radius than that of support 22. The gaps or recesses 23 in the support 22 have been shown in broken lines in FIG. 3. The centers of the rounded portions 25, 26 of each two respective gaps or recesses 23 arranged at both supports 21, 22 are located along straight lines which are parallel to the container floor 24 and the wall 20. The spacing of the boundary surfaces 28, 29 of the gaps 23 is greater than the diameter of the cartridges 7 which are stacked in the container 50. Connected with the upper portion of the intermediate walls 19 are flap members 30 of the type taught in Swiss Pat. No. 476,972 (U.S. Pat. No. 3,461,774), the disclosure of which is incorporated herein by reference.

According to FIG. 3 the necks 31 and the rear portions 31*a* of the sleeves 7*a* of the cartridges 7 interconnected by the belt elements 14 of a part 32 of the belt loop located in the compartment 54 are mounted in a pair of gaps 23 at the two supports 21, 22.

The other part 33 of the belt loop is freely suspended or hanging in the compartment. The belt portions 32, 33 are guided over the flap members 30 which thus serves as support points for the cartridges 7 which are not supported by the supports 21, 22. The number of gaps or recesses essentially determines the number of cartridges 7 which can be housed or accommodated in a compartment. During emptying of a compartment the entire belt portion 33 is moved in the direction of the arrow F (FIG. 4), so that by means of the belt portion 32 one cartridge 7 after the other is pulled out of the gaps or recesses 23 of the supports 21, 22. By means of the inclined upwardly directed surfaces 28 the cartridges 7 are held back in the gaps 23 until they are pulled-out. In this way there is prevented that the cartridges 7 already before or during the withdrawal out of the gaps or recesses 23, are moved and come into contact with the belt portion 33.

While there is shown and described present preferred embodiments of the invention, it is to be distinctly understood that the invention is not limited thereto but may be otherwise variously embodied and practiced within the scope of the following claims.

Accordingly, what is claimed is:

1. An ammunition container for the reception of a looped cartridge belt, comprising:

a. a container structure;

b. a plurality of supports arranged in said container structure so as to form therein a number of compartments, each compartment containing a loop of the cartridge belt;

c. each support being equipped with spaced teeth extending the length thereof forming a plurality of aligned recesses for receiving cartridges therein;

d. each loop of the cartridge belt consisting of two loop portions, one loop portion bearing against one support of the associated compartment and the other loop portion bearing against an oppositely situated support of such compartment, said loop portion containing a number of cartridges which correspond to the number of recesses in said support; and e. each recess of the support of each associated compartment having arranged therein a respective cartridge of one loop portion of a loop of the cartridge belt located in such compartment.

2. The ammunition container as defined in claim 1, wherein two of said supports form an intermediate wall.

3. The ammunition container as defined in claim 1, wherein the teeth of each support are upwardly inclined in order to prevent unintentional sliding out of the cartridges from the recesses of such support.

4. The ammunition container as defined in claim 1, wherein each compartment is bounded by a side of the support provided with the teeth and an oppositely situated wall devoid of said teeth.

5. The ammunition container as defined in claim 4, wherein said oppositely situated wall devoid of teeth is defined by a side of a support which is located opposite its side provided with said spaced teeth.

* * * * *